US009138024B1

(12) United States Patent
Solomon

(10) Patent No.: US 9,138,024 B1
(45) Date of Patent: Sep. 22, 2015

(54) JEANIE HAIR BAND EXTENSION SYSTEM

(71) Applicant: Kerita Kaye Solomon, Sanford, FL (US)

(72) Inventor: Kerita Kaye Solomon, Sanford, FL (US)

( * ) Notice: Subject to any disclaimer, the term of this patent is extended or adjusted under 35 U.S.C. 154(b) by 0 days.

(21) Appl. No.: 14/337,218

(22) Filed: Jul. 22, 2014

Related U.S. Application Data

(60) Provisional application No. 61/967,101, filed on Mar. 11, 2014.

(51) Int. Cl.
*A41G 3/00* (2006.01)
*A41G 5/00* (2006.01)
*A45D 8/36* (2006.01)

(52) U.S. Cl.
CPC ..... *A41G 5/0093* (2013.01); *A41G 5/0073* (2013.01); *A45D 8/36* (2013.01)

(58) Field of Classification Search
CPC ..... A41G 3/00; A41G 3/0008; A41G 3/0016; A41G 3/0033; A41G 3/0041; A41G 3/005; A41G 5/00; A41G 5/0013; A41G 5/0026; A41G 5/004; A41G 5/0053; A41G 5/0073; A41G 5/0093; A45D 8/36; A45D 2008/002; A45D 2008/004
USPC ..... 132/53, 200, 201, 105, 273–276, 132/54–56; 2/171, 171.8, 181, 209.13, 209, 2/14; 434/94; 446/394
See application file for complete search history.

(56) References Cited

U.S. PATENT DOCUMENTS

| | | | | |
|---|---|---|---|---|
| 1,665,380 | A * | 4/1928 | Ruffio | 132/105 |
| 3,295,536 | A * | 1/1967 | Shaw et al. | 132/53 |
| 4,966,173 | A * | 10/1990 | Russell | 132/54 |
| 5,337,763 | A * | 8/1994 | Haber et al. | 132/54 |
| 5,647,384 | A * | 7/1997 | Haber et al. | 132/105 |
| 5,899,211 | A * | 5/1999 | Brown | 132/201 |
| 6,766,805 | B1 * | 7/2004 | Cupp | 132/53 |
| 7,533,676 | B2 * | 5/2009 | Sthair | 132/201 |
| 7,735,495 | B2 * | 6/2010 | Lane et al. | 132/53 |
| 8,161,980 | B2 * | 4/2012 | Inoue et al. | 132/53 |
| 8,381,741 | B2 * | 2/2013 | Montgomery | 132/201 |
| 8,689,807 | B2 * | 4/2014 | Nagatomo et al. | 132/145 |
| 2006/0174905 | A1 * | 8/2006 | Bias | 132/53 |
| 2008/0178902 | A1 * | 7/2008 | Moeszinger | 132/273 |
| 2009/0235945 | A1 * | 9/2009 | Eaton | 132/105 |
| 2009/0241974 | A1 * | 10/2009 | Hampton | 132/54 |
| 2010/0154812 | A1 * | 6/2010 | Westerman Holstijn | 132/54 |
| 2012/0222692 | A1 * | 9/2012 | Ray | 132/53 |
| 2015/0013710 | A1 * | 1/2015 | Buzaglo et al. | 132/201 |

* cited by examiner

*Primary Examiner* — Vanitha Elgart

(57) ABSTRACT

The purpose of the invention is to create an easily installed accessory that yields a natural look in hair styling versatility and reduces damage to natural hair and scalp. It is made to alter the appearance of a wearer's natural hair, by adding length and/or volume. The unit comprises of a breathable mesh fabric, with multiple layers of wefted hair extension fibers (hair pieces) sewed on to the top surface of it. To the underside of the mesh fabric, are three metal hair clips that help to secure the unit in place. Connected bilaterally to the mesh fabric, is a satin covered elastic hair band that functions in conforming to the wearer's head during installation and use of the unit. When the hair band extension system is used, hair is adorned attractively and the breathability and moisture conserving qualities help to promote healthy hair and scalp.

3 Claims, 4 Drawing Sheets

JEANIE HAIR BAND EXTENSION SYSTEM

DETAILED DESCRIPTION OF THE INVENTION

Figure 1:
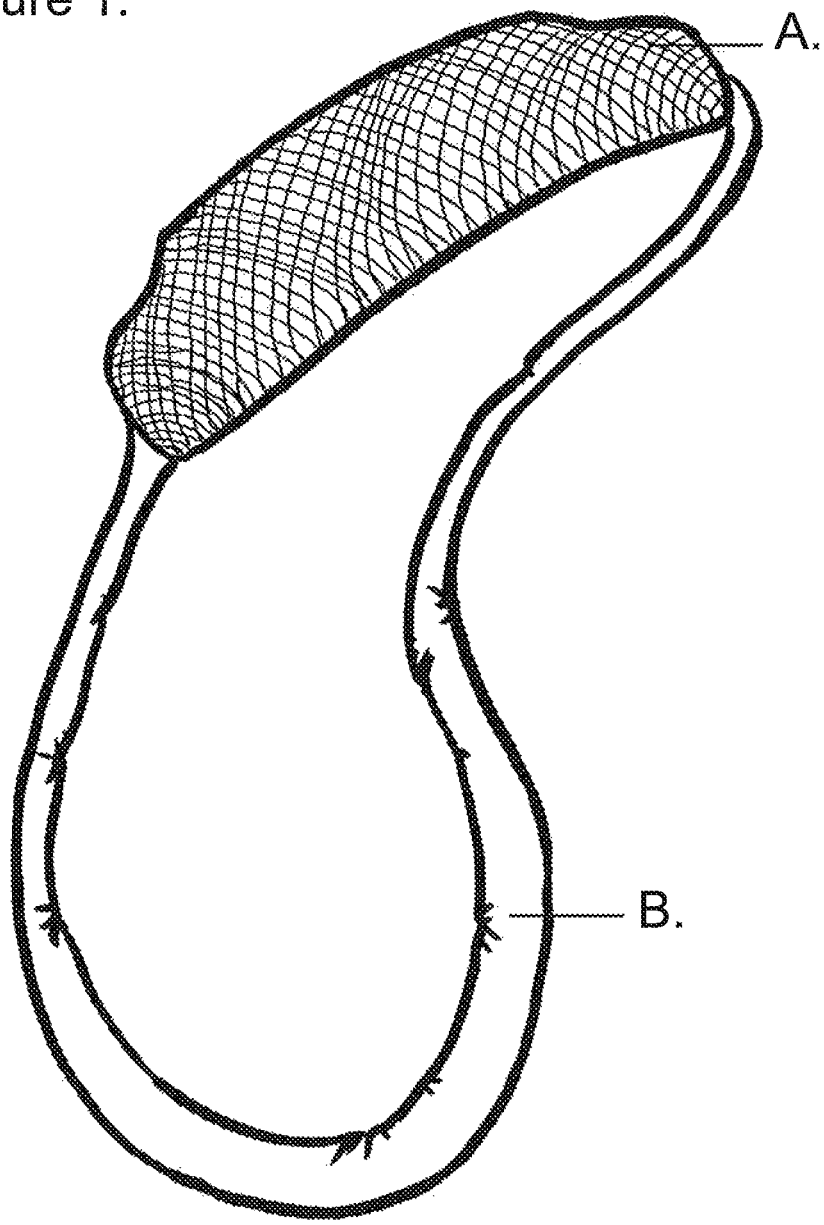

I, Kerita Kaye Solomon have invented a hair band extension system as set forth in the following specification: The claimed invention referring to provisional application No. 61/967,101 filed on Mar. 11, 2014 provides a unique hair accessory to be used for domestic purposes relative to hair adornment and styling.

The Hair Band Extension System is an easily installed hair accessory that is comfortable to wear. It is made for altering the appearance of a wearer's natural hair, by adding length and/or volume to a variety of hair styles, including ponytails. The unit is constructed by using a sewing machine. Its parts consists of: A, a mesh or lace-like fabric measuring approximately 3×6 inches, C, three metal hair clips, D, wefted hair fibers sourced from human or synthetic hair, and B, a flexible elastic hair band that is covered with soft satin fabric and measures about ⅜ of an inch in width.

The mesh material A, helps with scalp breathability and is the base structure of the connecting parts. Three combed-teeth hair clips C, are attached to an under surface of the mesh fabric A, by sewing. They snap in place and serve to anchor the unit to the wearer's natural hair, resting on the scalp upon installation. Also, attached to a top surface of the mesh fabric A, are multiple rows of wefted hair fibers D, (hair pieces), which function in adding the effect of length and volume to the wearer's natural hair. To each side of the mesh structure A, is an attached satin covered elastic hair band, B. The elastic hair band B, serves to adjust and conform the unit to the circumference of the wearer's head accordingly, ensuring a proper fit.

When worn, the Hair Band Extension System gives the illusion of a naturally long, voluminous appearance to limp and for short hair. The unit is to be worn under natural hair and is to be covered by the wearer's natural hair after being secured. Installation is completed in three easy steps. Firstly, the wearer's natural hair is sectioned off in the front, sides and back of the head by parting with a comb. Secondly, the unit is then applied and positioned to fit the head comfortably by gently snapping the three hair clips C, in place on the scalp on to the wearer's natural hair for security. The soft, elastic hair band B, is then gently positioned to conform to the head's circumference, extending from the frontal portion, to the posterior portion of the wearer's head, while resting on the scalp. Thirdly, the wearer's natural hair is combed over the unit, covering all exposed areas before styling as usual.

The present embodiment relates to half wigs and clip on hair extensions, that are used for the purposes of adorning and supplementing natural hair. Various methods and products used for altering the appearance of hair exists; however, some of them can be damaging to the health of natural hair. Adhesives can be damaging to natural hair and scalp, and traditional bonding methods can be time consuming and expensive. Individually wefted clip on hair extensions are a common trend in hair styling, but they can also be a challenge to install and wear. To add length and/or volume in most cases, the placement of multiple pieces of individual clip on hair extension tracks, to multiple parted sections of a wearer's natural hair is required. For many people, this can be a very time consuming task, which demands specific skill. Also, individually wefted clip on hair extensions often get tangled, due to friction caused by cuticle in natural hair, coupled with movement. Tangling requires constant grooming and maintenance, which adds stress to natural hair and scalp and could lead to natural hair damage over time. Half wigs do offer some advantages, but because they are often bulky, they make blending with natural hair difficult, and seldom yield natural looking results. Furthermore, half wigs may limit hair and scalp breathability, which could also cause damage to natural hair. Given these issues, the need exists for a more user friendly technology that can deliver desirably natural looking results in hair styling, while substantially limiting damage to natural hair and scalp.

Jeanie Hair Band Extension System provides an alternative option for styling hair, and offers a user friendly design, engineered for comfort and convenience. It saves time on installation, adorns hair attractively, and substantially limits the damaging effects of excessive stress on a wearer's natural hair and scalp. The present embodiment features: a mesh material A, which functions to promote scalp breathability, multiple layers of wefted hair fibers D, sewed on to a top surface of the mesh fabric A, for delivering the look of added volume and/or length to natural hair, three metal hair clips C, attached to an underside surface of the mesh fabric, A for securing the unit, and a bilaterally attached satin lined elastic hair band B, to each side of the mesh material, A The flexible hair band B, is thin and flat. It conforms to the circumference of the wearer's head for a proper fit, and gives additional support during use. Another important function of the satin lined elastic hair band B, is to conserve moisture in the wearer's natural hair, while adding comfort, decreasing natural hair breakage, and promoting a healthier hair and scalp.

There's a constant demand for easy, quality solutions in several areas of technology, and hair is no exception. Today's women want their hairstyles to look and feel as natural as possible. They seek variety, convenience and comfort. As a result, new tools for hair styling that can deliver great results with very little time and effort is needed. The present embodiment presents a solution, because it is easily installed, delivers desirable results with little time and effort and, it is very comfortable to wear. When properly installed, the Hair Band Extension System is concealed under a wearer's natural hair, and is seamlessly undetectable. This yields a more natural looking result of added length and/or volume to a wearer's hair, while promoting healthy hair and scalp. Bulkiness, ridges and bumps are unseen, because it has a flat, smooth design. Also, because the unit is secured under the wearer's natural hair by three hair clips, C and the support of an elastic, satin lined hair band B, it stays on as the wearer goes about her day; therefore, the unit will not become easily displaced with wind or body movements.

BACKGROUND OF THE INVENTION

U.S. Pat. No. 8,381,741 to Montgomery discloses a headband with a hair piece device for supplementing existing hair. The hair piece base couples to a crown piece, so that a U-shaped headband, made of flexible plastic material holds the hairpiece in place on the scalp. Montgomery also discloses that the headband may have teeth that grips the scalp. U.S. Pat. No. 7,735,495 to Lane et al. discloses a partial cap hair accessory for supplementing the natural hair of a user to be worn only at the rear portion of the head. A head band attachment for Lane et al's claimed invention is not disclosed. U.S. Patent Application No. 2008/0178902 to Moeszinger discloses an adjustable head band and hair extension holding construction for attaching supplemental hair. The head band is made of fabric which may include satin, and has adjusting clasps for increasing or decreasing the circumference of the head band relative to the size of the wearer's head. Moeszinger also discloses that the headband conceals the hair extensions that are attached underneath the headband, but it is not disclosed that the fabric portion of the headband is concealed under the wearer's natural hair when worn.

BRIEF DESCRIPTION OF THE INVENTION

The Hair Band Extension System is to be used for hair adornment and styling. It composes of a 3×6 inches mesh fabric A, with three metal hair clips C attached to its underside, and multiple strands of wefted hair D (hair pieces), sewed to its top surface. Attached bilaterally, to each side of the mesh fabric A, is an elastic hair band B (⅜ inches in width) covered with smooth satin fabric. The unit is to be worn under natural hair, covering all exposed areas before styling. When installed, it adorns natural hair attractively by adding length and volume. The smooth, satin fabric covering the elastic hair band B, minimizes breakage by conserving moisture during use. It also provides a comfortable fit with less irritation and pulling on the wearer's hair and scalp. The mesh fabric functions to minimize hair breakage as well. It promotes hair and scalp breathability. The invention is a unique and convenient hair accessory that is easy to install and comfortable to wear. It can be used by individuals of various ethnicities for creating versatility in hair styling.

SEVERAL VIEWS OF DRAWINGS DESCRIPTION

The Hair Band Extension System composes of a (3×6 inches) mesh fabric A with multiple welted hair fibers D (hair pieces sourced from human or synthetic hair) sewed to a top surface of the mesh fabric A, a satin covered, elastic hair band B bilaterally attached to each side of the mesh fabric A, and three metal hair clips C attached to an underside surface of the mesh fabric A.

FIG. 1 is a perspective view displaying two of the main components of the unit, the mesh fabric A and the hair band B attached. For visual illustration purposes, the other parts are excluded from the drawing. A is the mesh fabric material and B points to the attached satin covered elastic hair band that helps with the fit and security of the unit.

Figure 2:
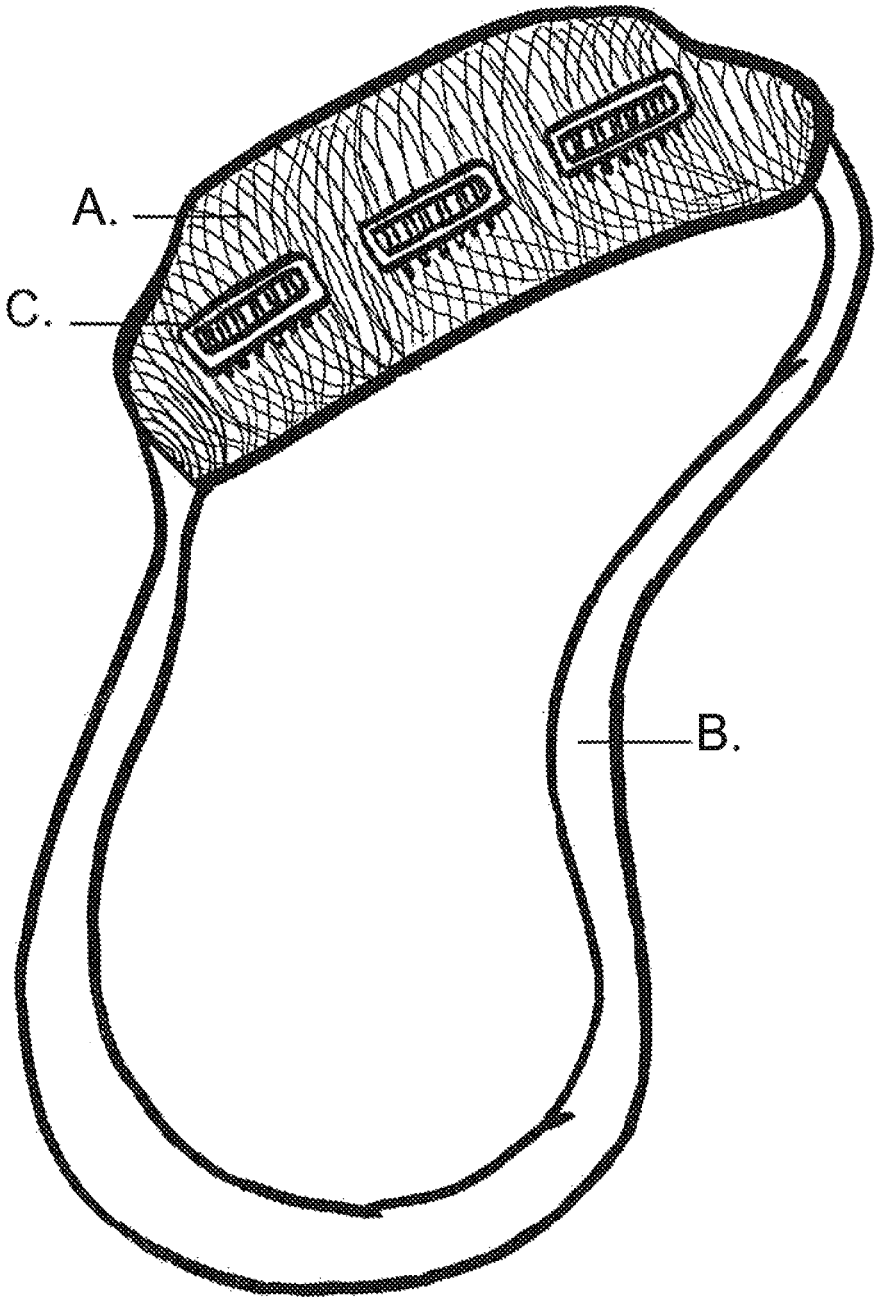

FIG. 2 shows the underside view of the mesh structure A. For visual demonstration purposes, other parts are excluded from the drawing. A is the mesh fabric material that serves as the base structure of the unit and helps with hair and scalp breathability. B is the satin covered, elastic fibered hair band that extends from the front to the back of the wearer's head during installation and serves to secure a proper fit. C points to one of the three evenly spaced metal hair clips that will rest on the scalp during installation and, snap into place for securing the unit to the wearer's natural hair.

Figure 3:
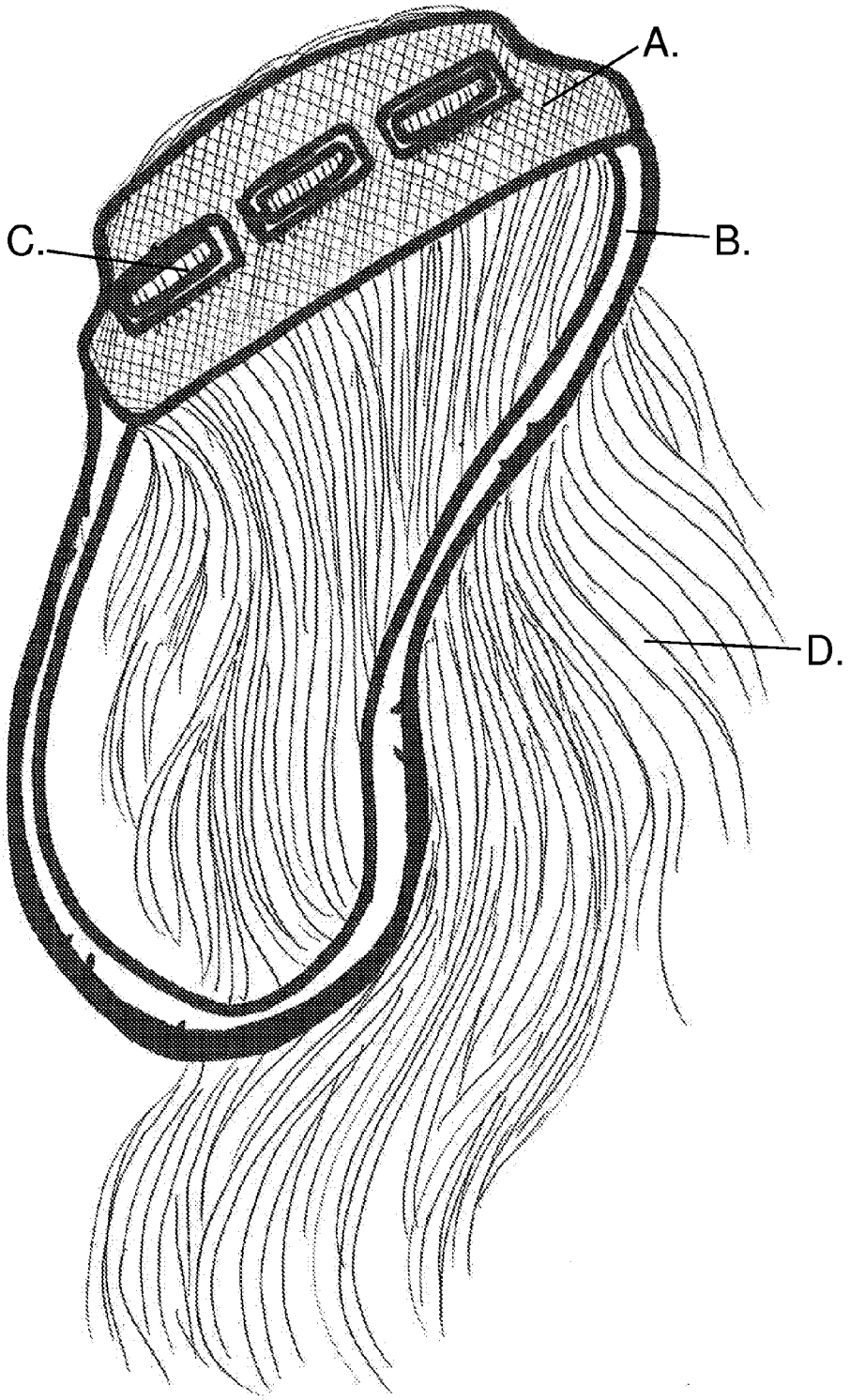

FIG. 3 is a perspective view of the Hair Band Extension System with all its components intact. The wefted hair fibers D, are sewed on to the mesh fabric A and the elastic hair band B is attached bilaterally to each side of the mesh fabric A. In this drawing, A is the mesh fabric, B is the elastic, satin covered hair band, C is one of the three metal hair clips attached to the mesh fabric and D shows the attached wefted hair fibers that have been sewed on to the mesh fabric A. The hair fibers D function in adding volume and length to the wearer's natural hair upon installation.

Figure 4:
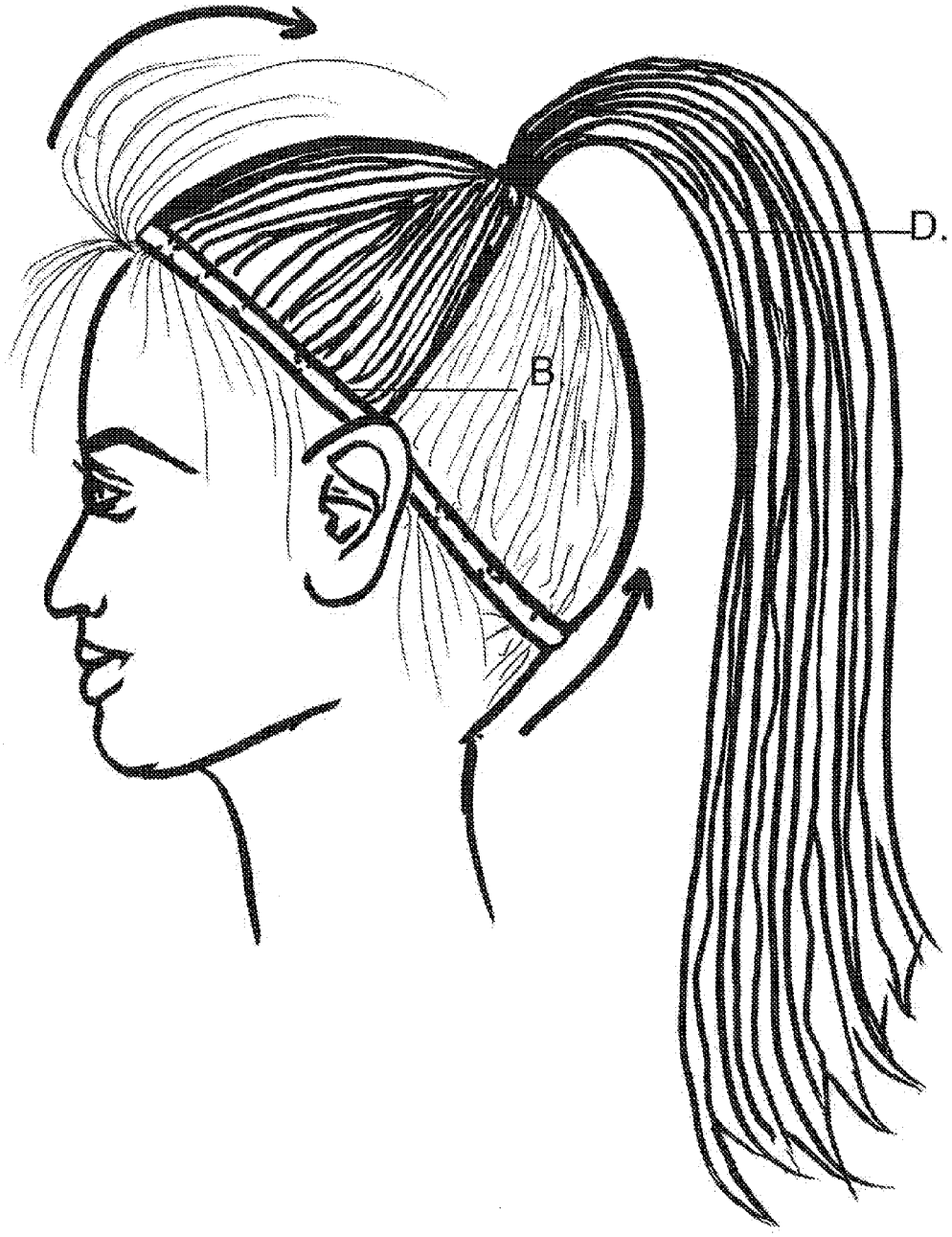

FIG. 4, is a visual of the Hair Band Extension System installed. As illustrated, B is the elastic hair band covered by soft satin fabric and D shows the wefted hair fibers which are sewed onto the mesh fabric, A. In the drawing illustrated, the wearer's hair is prepped prior to installation. The process involves the wearer's natural hair first being sectioned off in the front, sides and back by parting with a comb. The unit is then secured to the wearer's head by the hair clips C, snapped into place on the scalp, and by the hair band B extending from the front to the back of the head while resting on the scalp. The wearer's natural hair is then combed away from the face and over the unit, covering all exposed areas before styling as usual. In the example, a ponytail hairstyle is achieved by gathering the wearer's natural hair with the hair extensions D, into a bundle and securing with a rubber band or tie.

The embodiments of the invention in which an exclusive property or privilege is claimed are defined as follows:

1. A hair band extension system comprising:

A base of mesh fabric material having a center section, a top side, a bottom side, a first end, and a second end, said center section being wider than said first and second ends; three small metal hair clips sewn to said bottom side of said base; a plurality of wefted hair extension fibers sewn to said top side of said base; and an elastic hair band covered in satin fiber and having a first end and a second end, said first end of said band sewn to said first end of said base and said second end of the band sewn to said second end of said base thereby forming a loop; wherein said hair clips are adapted to be secured to a wearer's natural hair so that said base is adjacent the top of the wearer's head and said elastic hair band formed in a loop is adapted to fit about the sides and back of the wearer's head, the wearer's natural hair adjacent the top of the wearer's hair covering said center section of said base mesh fabric material and said wefted hair extension fibers, and said fibers blending in with the wearer's natural hair.

2. The hair band extension system of claim 1 wherein: The wefted hair extension fibers are sourced from human or synthetic hair.

3. The hair band extension system of claim 1 wherein: each of the three metal hair clips has comb teeth that engage with a wearer's natural hair upon installation, and help with attachment.

* * * * *